US005405291A

United States Patent [19]

Alcorn et al.

[11] Patent Number: 5,405,291

[45] Date of Patent: Apr. 11, 1995

[54] ADAPTIVE FEEDFORWARD LABORATORY CONTROLLER WITH PROPORTIONAL/INTEGRAL CALCULATION

[75] Inventors: Larry H. Alcorn, Greensburg; Walter L. Coxson, Washington; Todd D. Wade, Bridgeville; Kenneth M. Bobuk, Duquesne; Charles E. Pitchford, West Mifflin, all of Pa.

[73] Assignee: Voltec Incorporated, McMurray, Pa.

[21] Appl. No.: 157,850

[22] Filed: Nov. 24, 1993

[51] Int. Cl.[6] ..... B08B 15/02

[52] U.S. Cl. ..... 454/61

[58] Field of Search ..... 454/56, 57, 58, 59, 454/61

[56] References Cited

U.S. PATENT DOCUMENTS

| | | | |
|---|---|---|---|
| 4,528,898 | 7/1985 | Sharp et al. . | |
| 4,706,553 | 11/1987 | Sharp et al. . | |
| 4,934,256 | 6/1990 | Moss et al. | 454/61 |
| 5,090,303 | 2/1992 | Ahmed | 454/58 |
| 5,090,304 | 2/1992 | Egbers et al. | 454/59 |
| 5,092,227 | 3/1992 | Ahmed et al. | 454/61 |
| 5,115,728 | 5/1992 | Ahmed et al. | 454/61 |
| 5,170,673 | 12/1992 | Ahmed et al. | 454/56 |

*Primary Examiner*—Harold Joyce
*Attorney, Agent, or Firm*—Kirkpatrick & Lockhart

[57] ABSTRACT

The apparatus may be implemented in software which performs the following steps: calculating a desired air velocity in the exhaust duct from a first input signal representative of the size of a variable sash opening and a first user defined setpoint representative of a desired face velocity; comparing successive values of the desired air velocity to determine any absolute and percent change therebetween; comparing the absolute change to a user defined reset deadband value; producing output signals, responsive to a second input signal representative of the measured air velocity in the exhaust duct and the second comparing step, for input to the fan so as to force the measured air velocity toward the desired air velocity. The production of the output signal is accomplished by adaptive, feedforward techniques when the absolute change is greater than the reset deadband and is accomplished by proportional/integral techniques when the absolute change is less than the reset deadband. A timer is provided to lockout the production of output signals produced by employing proportional-/integral techniques for a predetermined period of time after an output signal is produced by employing adaptive, feedforward techniques.

7 Claims, 3 Drawing Sheets

| | |
|---|---|
| 0 | 0 |
| 100 | 10 |
| 200 | 15 |
| | |
| 700 | 80 |
| 1000 | 100 |

ADAPTIVE FEEDFORWARD LABORATORY CONTROLLER WITH PROPORTIONAL/INTEGRAL CALCULATION

BACKGROUND OF THE INVENTION

1. Field of the Invention

The present invention relates generally to heating, ventilating, and air conditioning systems and more particularly to a controller of the type used to control ventilation within a laboratory.

2. Description of the Background of the Invention

Laboratory environments are typically provided with various types of ventilation equipment. One common piece of ventilation equipment is a fume hood. A fume hood is an enclosure having a movable door or doors, sometimes called a sash, at a front opening to provide access to the interior of the enclosure for conducting experiments, mixing chemicals, or the like. The fume hood is typically connected to an exhaust system for generating a flow of air through the fume hood to remove any noxious fumes or the like from the interior of the enclosure. Exhaust systems may include blowers that are capable of being driven at variable speeds to increase or decrease the flow of air from the fume hood to compensate for various sash positions. Alternatively, there may be single blower connected to an exhaust manifold that is in turn connected to the individual ducts exiting the fume hoods. Dampers may be provided in the individual ducts to modulate the flow from the individual ducts as required.

The velocity of the air flowing through the hood opening is called the face velocity. The average face velocity is typically defined as the flow of air into the fume hood per square foot of open face area of the fume hood, with the size of the open face area being dependent upon the position of the sash, and, in most types of enclosures, the amount of bypass opening that is provided when the sash is closed. The minimum acceptable face velocity is determined by the level of hazard of the materials being handled, and guidelines have been established relating face velocity to toxicity. Typical minimum face velocities for laboratory fume hoods are 75–150 feet per minute (FPM). The more hazardous the material being handled, the higher the recommended face velocity. However, too high a face velocity may cause turbulence, which can result in contaminants escaping from the hood. Additionally, high face velocities can be annoying to the operator and may damage fragile apparatus in the hood. As the sash position is varied, and the face velocity is changed due to changes in the toxicity of the materials used in the hood, it becomes increasingly difficult to maintain the face velocity constant.

To maintain a more constant face velocity as the sash is moved up and down, "bypass" hoods have been developed. A bypass hood has an opening, called a bypass opening, through which air can enter the fume hood when the sash is fully closed. Conversely, the bypass opening is blocked when the sash is fully opened. As the sash is moved from the fully closed to the fully opened position, the bypass opening is gradually moved from the fully opened to the fully closed position. Although bypass openings can provide some measure of control with respect to the face velocity, it is typically not possible to provide a bypass opening of the same size as the opening in the fume hood. Accordingly, it becomes necessary to vary either the blower speed or the position of the damper, depending upon the type of exhaust system in use.

It is known that the face velocity can be calculated by monitoring exhaust duct air velocity by means of a flow sensor. It has proved difficult, however, to provide sensors which reliably monitor air flow. Air flow sensors are costly and non-linear. They are also subject to contamination by materials in the exhaust air which lead to errors in calculating the actual face velocity. Attempts to use pressure sensors to measure flow have not met with success due to the very low pressure drops which typically exist in the exhaust duct.

To date, there are two primary methods employed in controlling fume hood face velocity. The most popular method uses a thermal anemometer, which indirectly measures face velocity through the hood side wall. This method provides direct measurement of face velocity, but exhibits slower than desired response characteristics. Further, the face velocity measurement can be affected by sensor position or hood setup. The second method controls the exhaust fan speed or positions a linear damper from a direct measurement of the sash position. That method has the advantage of great speed, but has the disadvantage of being unable to directly measure hood air flow or face velocity. That could result in large errors in face velocity over time, and is time consuming to set up.

U.S. Pat. No. 4,706,553 discloses a fume hood controller in which the sash position is monitored by a transducer that provides a signal indicative of the area of the hood opening. The variable speed motor controller is responsive to the sash position signal to provide a fan speed which varies in a substantially continuous, linear manner as a function of the sash opening. U.S. Pat. No. 5,090,303, is another laboratory fume hood controller which relies upon input signals indicating the sash position. The apparatus disclosed therein detects the position of each movable sash, calculates the size of the opening, measures the actual flow of air through the exhaust duct, and varies the flow of air through the exhaust duct in response to the position of the sash and the measured air flow.

There are a number of competing objectives in developing an alternative method for controlling fume hoods: decreased control response time; direct measurement of face velocity; simple installation, calibration and setup; simple control algorithm; and low cost. Problems encountered in trying to satisfy those objectives stem from the fact that the sash position may be changed very little, to provide a slight adjustment during an experiment, or a very large amount, very rapidly. Control systems set up to closely monitor minute changes in sash position typically take a long time to respond to large changes in sash position, particularly those changes which occur quickly. On the other hand, systems set up to quickly respond to large, fast, changes in sash position may be insensitive to small changes. Tradeoffs inevitably occur between response time and sensitivity. Thus, the need exists for a control system which is capable of responding quickly to changes in sash position without any loss in sensitivity.

SUMMARY OF THE PRESENT INVENTION

The present invention is directed to an apparatus for controlling the velocity of air flowing through the face of a fume hood of the type having a variable opening and connected to an exhaust duct having a fan, damper, etc. for varying the flow of air through the fume hood. The apparatus has the capability to "learn" what control signals need to be output to the fan or damper in given circumstances to produce a desired face velocity. Adaptive feedforward techniques are used in that regard to allow the apparatus to quickly respond to large changes in sash position. When smaller changes occur, a more traditional proportional/integral/derivative (PID) approach is used to generated the necessary output signal. A unique interlock, implemented in the preferred embodiment by software timers, determines whether the adaptive feedforward loop or the PID loop is responsible for producing the necessary output signal.

The apparatus of the present invention comprises a first sensor for producing a first input signal representative of the size of the variable opening, an input device for establishing various user selected parameters such as a first setpoint representative of a desired face velocity and a reset deadband value, and a second sensor for producing a second input signal representative of the measured air velocity in the exhaust duct. The apparatus of the present invention is, according to a preferred embodiment, implemented in software for preforming the following steps:

calculating a desired air velocity in the exhaust duct from the first input signal and the setpoint;

comparing successive values of the desired air velocity to determine any percent and absolute change therebetween;

comparing the absolute change to the reset deadband value;

producing output signals, responsive to the second input signal and the second comparing step, for input to the fan so as to force the measured air velocity toward the desired air velocity. The production of the output signal is accomplished by employing adaptive feedforward techniques when the absolute change is greater than the reset deadband and by employing proportional/integral techniques when the absolute change is less than the reset deadband. The use of adaptive feedforward techniques allows the apparatus to "learn" what signals to produce in a given set of circumstances. The present invention also employs a timer which prevents the production of an output signal produced by employing PI techniques for a predetermined period of time after an output signal is produced by employing adaptive, feedforward techniques.

The apparatus of the present invention represents a substantial advance over the art. Whenever there is a rapid change in desired face velocity or a rapid change in sash position, the adaptive feedforward portion of the present invention can produce an output signal, based on previous experience, which will rapidly force the actual face velocity value toward the desired face velocity value. During that time, the interlock mechanism inhibits the PI portion of the apparatus from producing output signals. After the actual face velocity has been brought within a certain percentage of the desired face velocity, and remained there for a period of time, the interlocked mechanism turns control over to the PI portion of the invention so that further refinements of the fan speed can be accomplished using PI techniques. Thus, the present invention enjoys the benefits of being able to rapidly adjust to large changes while at the same time maintaining a high degree of sensitivity to small changes. Those, and other advantages and benefits of the present invention will be apparent from the Description of a Preferred Embodiment hereinbelow.

DESCRIPTION OF THE DRAWINGS

For the present invention to be easily understood and readily practiced, the present invention will now be described, for purposes of illustration only, in conjunction with a preferred embodiment in which.

DESCRIPTION OF A PREFERRED EMBODIMENT

A preferred embodiment of the present invention is disclosed in the environment of a fume hood controller. Those of ordinary skill in the art will recognize, however, that the principles of the present invention may be applied to a large number of ventilation applications, particularly in the laboratory setting.

Figure 1:
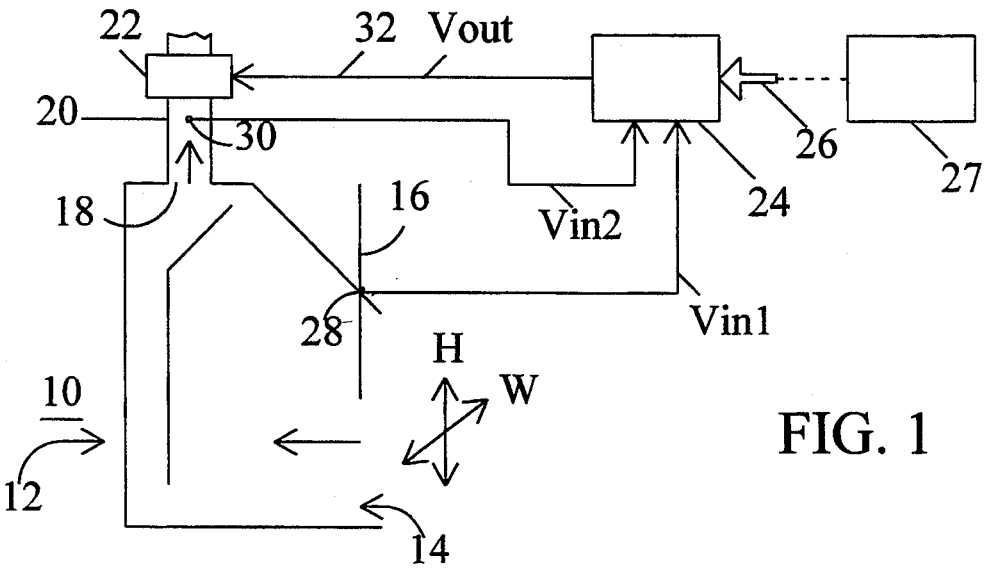
FIG. 1 illustrates a fume hood connected to an exhaust duct of an exhaust system.

In FIG. 1, a fume hood 10 is illustrated. As is known, the fume hood 10 is comprised of an enclosure 12 having an opening 14 in the front wall thereof. The opening 14 can be closed by changing the position of a door 16, sometimes referred to as a sash. The sash 16 may occupy an infinite number of positions between the fully opened position illustrated in FIG. 1 and a fully closed position (not shown). The enclosure 12 has an exit port 18 which is connected to an exhaust duct 20. Positioned in the exhaust duct 20 is a fan or damper 22. Those of ordinary skill in the art will recognize that if a damper is positioned in duct 20, then a fan will typically be positioned somewhere else within the exhaust system. The purpose of the fan or damper 22 is to vary the amount of air flowing through enclosure 12.

In operation, the user inputs a desired face velocity, which is the velocity of the air entering through opening 14. The face velocity is one of a number of input signals produced, for example, by a keyboard of a personal computer 27. The input signals are represented collectively in FIG. 1 by arrow 26. A first input sensor 28 is responsive to the position of the sash 16 and produces a first input signal $V_{in1}$ representative of the sash's position. The sash's position is proportional to the height H of the opening 14. The width W of the opening 14 is constant such that provision of a signal representative of the height H of the opening enables the controller 24 to calculate the area of the opening 14.

The controller 24 also receives a second input signal $V_{in2}$ produced by a second input sensor 30. The signal $V_{in2}$ is representative of the actual velocity of the air flowing in duct 20. By knowing the velocity of the air flowing in duct 20, and knowing the area of opening 14, the controller 24 can calculate the actual face velocity. The actual face velocity is then compared to the desired face velocity and appropriate output signals $V_{out}$ are output from controller 24 to fan 22 on line 32.

Those of ordinary skill in the art will recognize that fume hoods 10 may be ganged and serviced by a single fan whereby each fume hood 10 is provided with a damper in exhaust duct 20 to vary the air flowing therethrough. Numerous other configurations are possible, and the present invention is not intended to be limited to any one particular configuration. The present invention is directed primarily to the construction and operation of the controller 24 which is discussed in greater detail hereinbelow.

Figure 2:
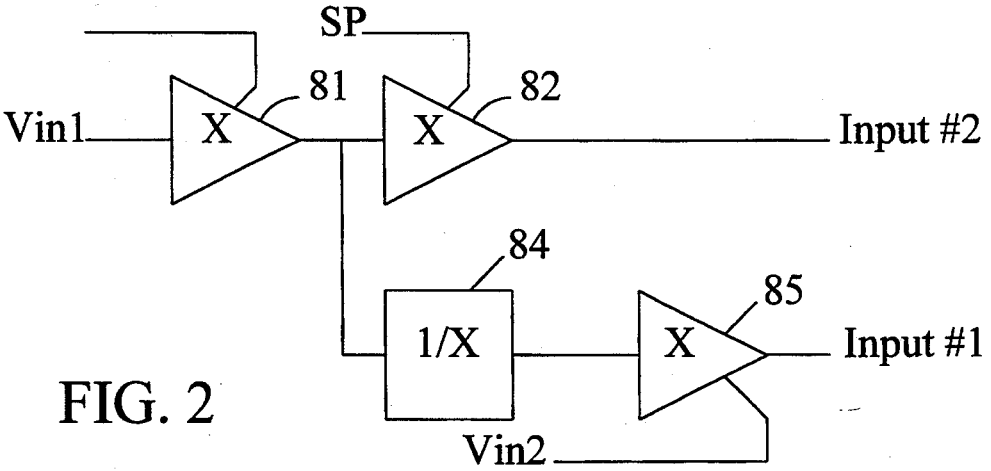
FIG. 2 is a block diagram illustrating the production of a signal representative of a desired air velocity in the exhaust duct.

Depending upon the application, it may be desirable for certain of the functions of the controller 24 to be performed by other components/modules such that the output of the component/module becomes an input to controller 24. Such a case is shown in FIG. 2, which is a diagram illustrating the production of a signal (defined as Input #2) that is representative of the desired air velocity in the exhaust duct 20. Input #2 is produced by block 81 which multiplies the first input signal $V_{in1}$ by a signal representative of the width of the sash opening to obtain a signal representative of the area of the sash opening. That signal is multiplied in block 82 by a user defined set point SP representative of a desired face velocity.

FIG. 2 further shows that the second input signal $V_{in2}$ is multiplied by the sash area by blocks 84 and 85 to produce a signal (defined as Input #1) which is representative of the measured air velocity in the exhaust duct 20.

Figure 3:
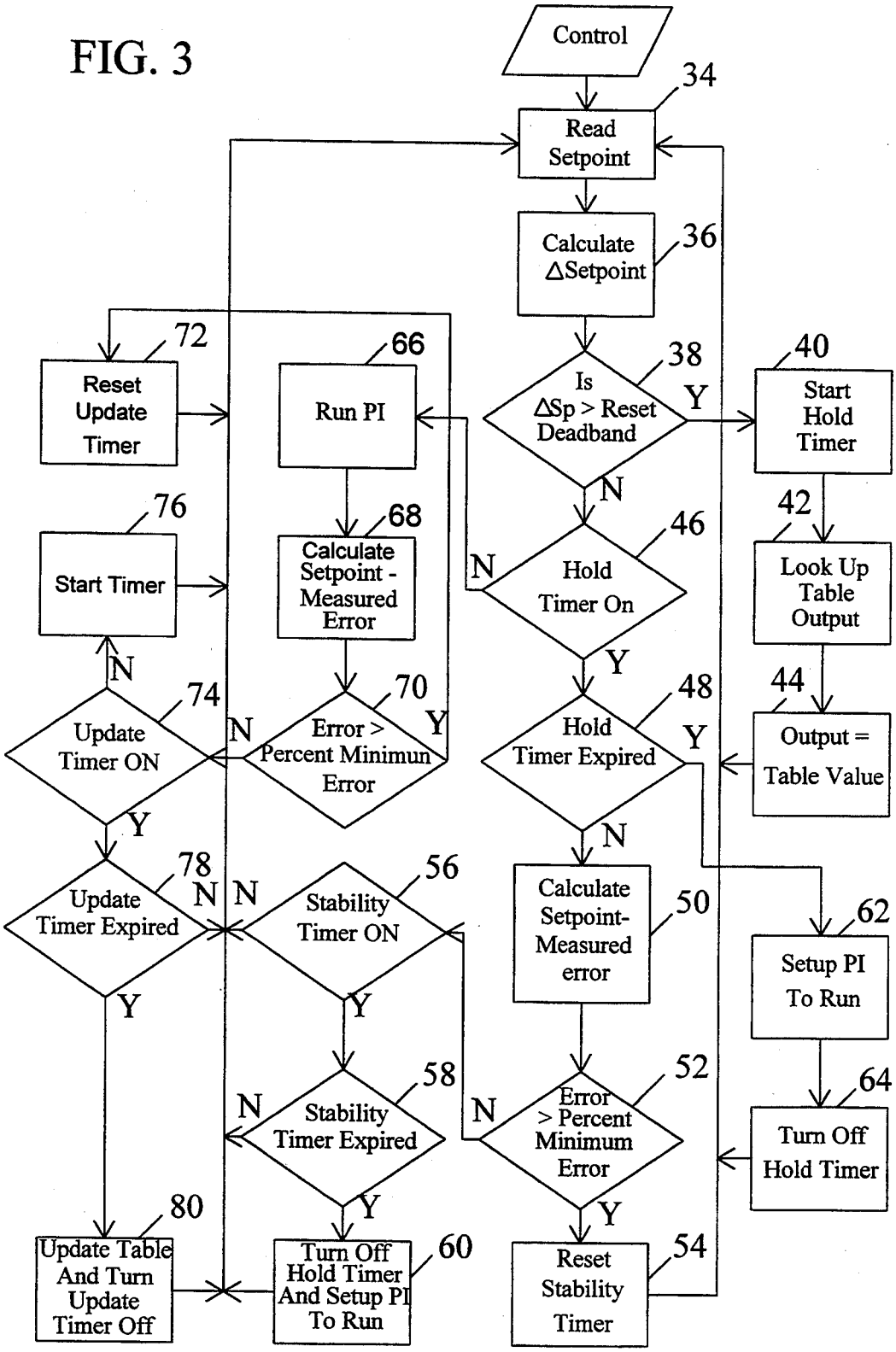
FIG. 3 is a flow chart illustrating the steps of the present invention.

Turning now to a discussion of FIG. 3, the controller 24 in FIG. 1, minus the functions which are performed by the module illustrated in FIG. 2, is implemented in the present invention in software. Those of ordinary skill in the art will recognize that the functions illustrated in FIG. 3 could also be implemented by hardware. The software of the present invention is represented by the flow chart of FIG. 3. The software is designed to receive a plurality of input signals which are defined as follows:

INPUT #1

Measured exhaust cfm setpoint—as determined by the second input signal $V_{in2}$ and the sash area. This input is the output of the module shown in FIG. 2.

INPUT #2

Exhaust cfm setpoint—as calculated from the sash position signal $V_{in1}$ and the face velocity setpoint SP. This input is the output of the module shown in FIG. 2.

INPUT #3

Percent minimum error—percent minimum error that must exist between Input #1 and Input #2 for a predetermined length of time before the PI portion of this module will be used to update the adaptive feed forward table.

INPUT #4

Proportional Gain—for PI calculation.

INPUT #5

Integral Gain—for PI calculation.

INPUT #6

Maximum Expected Value of Input #2.

INPUT #7

Minimum Expected Value of Input #2.

INPUT #8

Output Hi Limit—Maximum value of output signal $V_{out}$.

INPUT #9

Output Low Limit—Minimum value of output signal $V_{out}$.

INPUT #10

Reset Deadband—value that must be exceeded by any change of Input #2.

INPUT #11

Hold Time—maximum absolute PI hold time.

The flow chart illustrated in FIG. 3 may be implemented by a computer program stored in any suitable hardware. The program begins at step 34 where the exhaust setpoint (Input #2) is read. The exhaust setpoint is representative of the desired air velocity in the exhaust duct and is the setpoint calculated in conjunction with the module of FIG. 2. That value is stored such that on the next pass through the program the stored value, which is the past value, is compared to the newly read value, and the newly read value becomes the stored value. In that manner, successive values of the desired air velocity are compared at step 36. If there is a difference between the past value and the preset value, that difference is expressed both in terms of a percent and absolute difference.

The absolute change is compared at step 38 to the reset deadband (Input #10). As previously defined, the reset deadband is a user selected value. The smaller the reset deadband, the more often the program will be directed toward the feedforward portion of the program. Conversely, the larger the reset deadband, the more often the program will be directed toward the proportional/integral (PI) portion of the program. Assuming, for purposes of this explanation, that the sash position has changed substantially such that there is a large absolute change between the present value of the desired air velocity in the exhaust duct and the past value of the desired air velocity in the exhaust duct, then the result of the comparison at step 38 is a positive response. Control proceeds to step 40 wherein a hold timer is started. The maximum value of the hold timer is selected by the user via Input #11. The hold timer performs the function of an interlock, to be explained more fully hereinbelow, which prevents the PI portion of the program from being run. In other words, when there is a large change in the desired face velocity, control is turned over to the feedforward portion of the program and the PI portion of the program is inhibited from running as a result of the operation of the hold timer.

After the hold timer has been started at step 40, the program proceeds in step 42 to look up in a table (See FIG. 5) the value for an output signal $V_{out}$ based on the desired value of the face velocity. After an appropriate value has been obtained from the table, the value is output at step 44 and control is returned to step 34.

According to one aspect of the preset invention, the feedforward portion of the program is an adaptive, feedforward loop which allows the program to "learn" to produce appropriate output signals under various circumstances. The adaptive lookup table of FIG. 5 has an input column of setpoints and an output column of control values. The table is built based upon the assumption that for every setpoint, there should be an output signal. Due to practical limitations, the current table has twenty entries. Each table input represents five percent of the span between the minimum expected value (Input

#7) and the maximum expected value (Input #6). Initially, the output table values are set by calculating the span between Inputs #6 and #7 and having each table entry represent five percent of the output span. After the table has been initially built, the program updates the table, i.e., learns which values are more appropriate.

Updating the table is the key to the adaptive feedforward aspects of the present invention. The exact manner in which the table is updated will be described in detail hereinafter. However, briefly, the program constantly monitors if the error between the measured value and the setpoint is below a preset error limit. If the error is less than the error limit, and it stays less than the error limit for a minimum time period, the table is updated. The table is updated by finding the correct table entry and putting the current value of the output signal into the table. The correct table entry is determined by determining the percentage of the current setpoint to the setpoint span. Knowing that each table entry is five percent, the correct table entry can be determined. The table entry will then contain the value needed to control the device at that particular setpoint. To ensure an accurate table, it is recommended that after initialization, the device be allowed to control at every table position to allow at least one update to occur. That adaptive feature allows the controller to continually adjust for changes in the controlled environment.

For purposes of illustration, we will assume that at step 34 there is no change between the present value of the setpoint and the past value of the setpoint such that the absolute change calculated in step 36 is zero. Accordingly, the absolute change is not greater than the reset deadband in step 38 and control proceeds to step 46. Step 46 is a decision step in which the program determines if the hold timer is on. Of course, in this illustration, the hold timer was set at step 40 so the answer at step 46 is yes and control proceeds to step 48. In step 48, a determination is made with respect to whether the hold time has expired. For purposes of this illustration, we will assume that the hold timer has not expired such that control proceeds to step 50.

In step 50, the difference between the desired value of the air flow in the exhaust duct (Input #2) and the actual value of the air flow in the exhaust duct (Input #1) as measured by sensor 30 is calculated. That difference, or error, is compared to a percent minimum error (Input #3) in step 52. The percent minimum error is a user defined value. For purposes of this illustration, we will assume that the error is greater than the percent minimum error because the system has not yet had adequate time to respond to a rapid change in sash position. Accordingly, an affirmative answer is generated at step 52 and control proceeds to step 54 where a stability timer is reset. Thereafter, control returns to step 34.

Proceeding from step 34, this time through the loop, we will assume that the change is zero, the hold timer is still on and has not expired, but that the error calculated in step 50 is now less than the percent minimum error. Accordingly, at step 52, a negative result directs control to step 56. Steps 56 and 58 determine whether the stability timer is on, and whether it has expired. The effect of steps 56 and 58 is to keep the controller cycling through the program until either the stability timer expires or the hold timer expires. If the stability timer times out before the hold timer, that is an indication that the signal produced in steps 42 and 44 has rapidly brought the actual face velocity to the desired face velocity. If that is the case, there is no reason to continue to hold the PI calculation in abeyance. Accordingly, at step 60, the hold timer is turned off and the PI portion of the program is set up to run. Conversely, if the stability timer does not time out before the hold timer times out, that is an indication that the output signal produced at steps 42 and 44 has not brought the actual face velocity sufficiently close to the desired face velocity to turn control over to the PI portion of the program. Accordingly, the PI portion of the program is held in abeyance until the hold timer times out. In effect, the hold timer provides an interlock mechanism which inhibits the PI portion of the program from running as long as large changes need to be made in output signal, which large changes can be more effectively handled by steps 42 and 44. After the large changes have been made, and the system is relatively stable, control can be turned over to the PI portion of the program. As seen in step 48, if the hold time has expired, the PI portion of the program is set up to run at steps 62 and the hold timer is turned off at step 64. Thereafter, control is returned to step 34.

Proceeding through the loop from step 34, and assuming there has been no further change in sash position, at step 46 a determination is made that the hold timer is no longer on. That is because either the stability timer has timed out and the hold timer was turned off at step 60 or the hold timer timed out and was turned off at step 64. In either event, control proceeds to step 66 in which a PI calculation is performed. The PI calculation is a standard PI calculation. As previously discussed, the PI portion of the program produces output signals only if it is not blocked out by virtue of operation of the hold timer. The PI portion of the program should not see large errors due to changes in setpoint because those errors will have been corrected by the adaptive feedforward portion of the program before control is turned over to the PI portion of the program. Because the PI portion of the program does not see large errors, it can be tuned to make only minor adjustments to achieve precision control. The PI calculation is discussed in greater detail hereinbelow in conjunction with FIG. 4.

After the PI calculation has been performed, control proceeds to step 68 and 70, which are the same as steps 50 and 52. That is, the error between the desired duct velocity (Input #2) and the measured duct velocity (Input #1) is calculated in step 68 and compared to the percent minimum error (Input #3) in step 70. As long as the error remains greater than the percent minimum error, a reset timer is continually updated at step 72 and control is returned to step 34. Alternatively, if at step 70 the error is less than the percent minimum error, control proceeds to step 74 in which a determination is made if the update timer is on. If the update timer is not on, it is turned on in step 76 and control is returned to step 34. If the update timer is on, a determination is made in step 78 as to whether the timer has expired. If not, control is returned to step 34. The purpose of steps 72, 74, 76, and 78 is to ensure that the error remains less than the percent minimum error for a predetermined period of time. Should that occur, then the table is updated in step 80, and the reset update timer is turned off. By updating the table with only those values which result in errors that are less than the percent minimum error for a predetermined period of time, the table is updated with output signals which are known to provide the desired velocity for a given sash position. Thus, any irregularities or nonlinearities in the system are learned such that the table provides a customized output signal appropriate for the particular device which it is controlling.

In summary, any change in desired air flow in the exhaust duct above a user selected percentage value will cause the apparatus of the present invention to do two things. First, the apparatus will look into a table for a new value for the output signal $V_{out}$. That new output signal is selected by looking at the new setpoint, finding the percentage of the setpoint span, and reading the table location that corresponds to it. Second, the apparatus, by virtue of the hold timer, will hold the PI portion of the program in abeyance. The PI portion of the program is held so that it does not respond until the output signal produced from the table has taken effect. The hold timer will be prematurely released, however, if the error between the measured value for the air flow in the exhaust duct and the desired value for the air flow in the exhaust duct is less than a percent minimum error. Otherwise, the PI portion of the program is held until the hold timer expires. In that manner, large changes in sash position can be quickly compensated for by the adaptive, feedforward portion of the program while smaller changes can be handled by the finely tuned PI portion of the program.

Figures 4, 5:
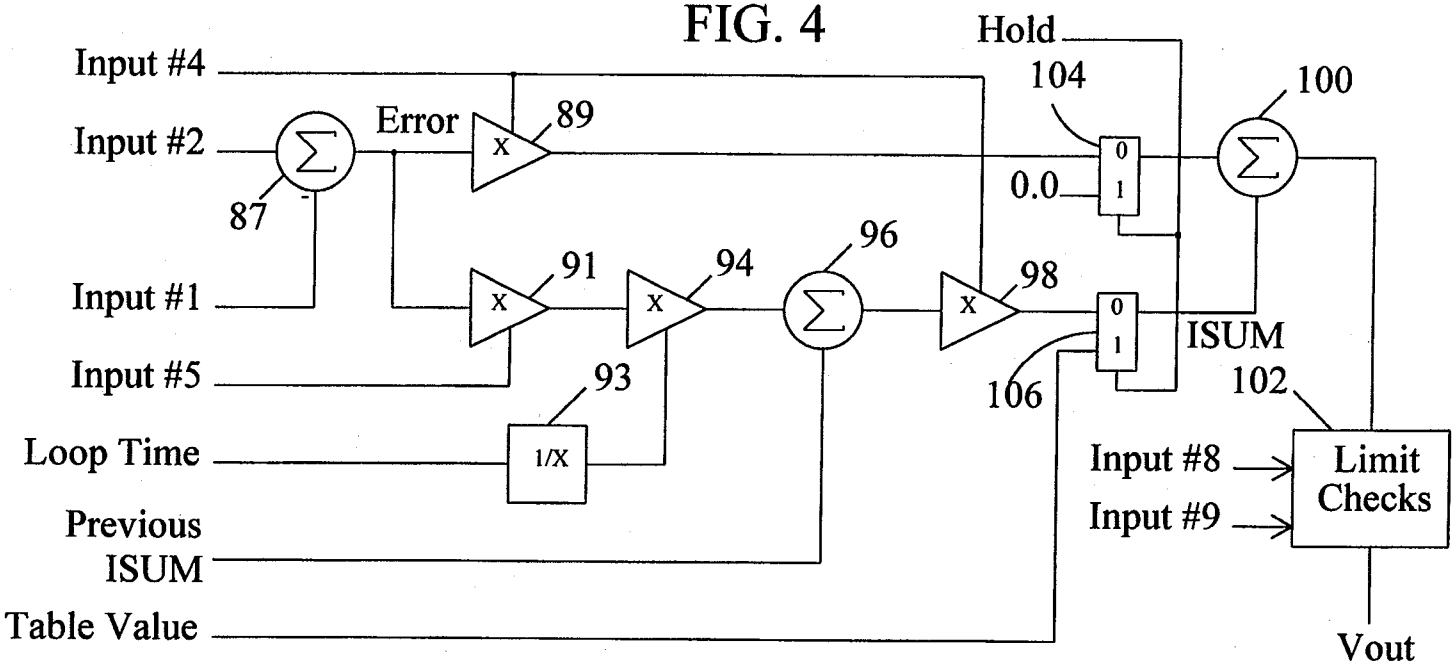
FIG. 4 is a block diagram illustrating the production of an output signal using PI techniques.
FIG. 5 illustrates a table used in conjunction with the adaptive, feedforward portion of the present invention.

Turning to FIG. 4, the PI portion of the program will now be discussed. The PI portion of the program is conventional in character. As shown in FIG. 4, the difference between Input #1 and Input #2 is calculated in block 87 to produce an error signal. The error signal is multiplied in block 89 by the proportional gain (Input #4). The error signal is also multiplied by the integral gain (Input #5) in block 91. The output of block 91 is multiplied by a loop time by blocks 93 and 94 and that result is added in block 96 to a previous value of ISUM. The result from block 96 is multiplied by the proportional gain (Input #4) to produce a new value of ISUM. The output signal $V_{out}$ is, thus, the sum of ISUM plus the error times Input #4. That value is produced in block 100. That value is subjected to limit checks in block 102. Specifically, the value is compared to the high limit (Input #8) and if it is greater than the high limit, then the output signal $V_{out}$ is equal to the high limit. Similarly, if the value produced in block 100 is less than the low limit (Input #9) then the value of the output signal $V_{out}$ is equal to the low limit. Otherwise, the value of the output signal $V_{out}$ is equal to the value produced by block 100.

The remainder of the components illustrated in FIG. 4 graphically illustrate the relationship between the PI portion of the program and the adaptive feedforward portion of the program. Specifically, two switches 104 and 106 are controlled by the hold timer previously discussed. Until the hold timer is turned off, the switches are maintained in a position such that the table value is passed through switch 106 and block 100 to become the outcome signal $V_{out}$. When the hold timer has timed out or is reset, the state of the switches 104 and 106 is changed such that the error signal times the proportional gain and ISUM are passed through switches 104 and 106, respectively, to block 100.

The fume hood control of the present invention is achieved by a combination of sash position measurement, exhaust duct air velocity measurement, and adaptive, feedforward control techniques. The preset invention uses the sash position sensor to directly control the exhaust duct air flow by using both feedforward and feedback control techniques. The face velocity is maintained by directly controlling the exhaust duct air flow, based upon the actual sash opening. Use of the feedforward control dramatically increases control response. By using direct sash position measurement, along with the feedforward plus feedback control, response times are increased by a factor of ten. The adaptive, feedforward portion of the system and simplified control algorithm significantly reduce the time and effort required for proper system tuning. The calibration of the sash position sensor will be limited to zero adjustment only, and the span of that sensor will be fixed. Also, the installation of the sash position sensor should be less time consuming and error prone than a hood velocity sensor. The software implementing the flow chart of FIG. 3 is straightforward and can be implemented with fewer modules. That consumes less computer resources and, because it is easier to understand, is easier to maintain. The system's installation cost is reduced in two ways. First, the sash position sensor is less expensive than a face velocity sensor and its associated mounting hardware. Second, the installation, calibration, and start up costs are also reduced. The apparatus of the present invention thus represents a substantial advance over the prior art.

While the present invention has been described in conjunction with a preferred embodiment, those of ordinary skill in the art will recognize that many modifications and variations may be made without departing from the spirit and scope of the present invention. Accordingly, this disclosure and the following claims are intended to cover all such modifications and variations.

What we claim is:

1. Apparatus for controlling the velocity of air flowing through the face of a fume hood of the type having a variable opening and connected to an exhaust duct having means for varying the flow of air through the fume hood, said apparatus comprising:

first sensor means for producing a first input signal representative of the size of the variable opening;

first means for establishing a setpoint representative of a desired face velocity;

means for calculating a desired air velocity in the exhaust duct from said first input signal and said setpoint;

first comparing means for comparing successive values of said desired air velocity to determine any change therebetween;

second means for establishing a reset deadband value;

second means for comparing said change to said reset deadband value;

second sensor means for producing a second input signal representative of the measured air velocity in the exhaust duct;

control means, responsive to said second input signal and said second means for comparing, for producing output signals for input to the means for varying so as to force said measured air velocity toward said desired air velocity, said control means employing adaptive, feedforward techniques when said change is greater than said reset deadband and employing proportional/integral techniques when said change is less than said reset deadband; and hold timer means for timing out a predetermined time period after the production of an output signal produced by employing adaptive, feedforward techniques and wherein the production of said output signal by employing proportional/integral techniques is dependent upon said change being less than said reset deadband and said hold timer means.

2. The apparatus of claim 1 wherein said control means includes means for storing a table of values for said output signal, said control means including means for selecting a value from said table in response to said change being greater than said reset deadband to thereby produce an output signal by employing adaptive, feedforward techniques.

3. The apparatus of claim 2 wherein said control means includes means for updating said table values whenever an output signal satisfies predetermined stability requirements.

4. The apparatus of claim 3 wherein said means for updating includes:

stability timer means for timing out a predetermined time period;

third means for establishing a percent minimum error value;

means for calculating the difference between said measured value and said desired value; and means for determining if said difference stays below said percent minimum error value for said predetermined time period timed out by said stability timer.

5. The apparatus of claim 4 wherein the predetermined time period timed out by said hold timer means is set to zero in the event the predetermined time period timed out by said stability timer means times out.

6. Apparatus for controlling the velocity of air flowing through the face of a fume hood of the type having a variable opening and connected to an exhaust duct having means for varying the flow of air through the fume hood, said apparatus comprising:

first sensor means for producing a first input signal representative of the size of the variable opening;

first means for establishing a setpoint representative of a desired face velocity;

means for calculating a desired air velocity in the exhaust duct from said first input signal and said setpoint;

first comparing means for comparing successive values of said desired air velocity to determine any change therebetween;

second means for establishing a reset deadband value;

second means for comparing said change to said reset deadband value;

second sensor means for producing a second input signal representative of the measured air velocity in the exhaust duct;

means for storing a table of values for an output signal;

means for selecting and outputting a value from said table in response to said second means for comparing indicating that said change is greater than said reset deadband value to thereby provide an output signal by employing adaptive, feedforward techniques;

hold timer means for timing out a predetermined time period after the production of an output signal selected from said table; and means, responsive to said second input signal, for producing an output signal by employing proportional/integral techniques in response to said second means for comparing indicating that said change is less than said reset deadband value and in response to said hold timer timing out said predetermined time period, said output signals being input to the means for varying so as to force said measured air velocity toward said desired air velocity.

7. A method for controlling the velocity of air flowing through the face of a fume hood of the type having a variable opening and connected to an exhaust duct having means for varying the flow of air through the fume hood, said method comprising the steps of:

producing a first input signal representative of the size of the variable opening;

establishing a setpoint representative of a desired face velocity;

calculating a desired air velocity in the exhaust duct from said first input signal and said setpoint;

comparing successive values of said desired air velocity to determine any change therebetween;

establishing a reset deadband value;

comparing said change to said deadband value;

producing a second input signal representative of the measured air velocity in the exhaust duct;

producing output signals, responsive to said second input signal and said second comparing step, for input to the means for varying so as to force said measured air velocity toward said desired air velocity, said producing step employing adaptive, feedforward techniques when said change is greater than said reset deadband and employing proportional/integral techniques when said change is less than said reset deadband; and timing out a predetermined time period after the production of an output signal produced by employing adaptive, feedforward techniques and wherein the production of said output signal by employing proportional/integral techniques is dependent upon said change being less than said reset deadband and said timing step.

* * * * *